US006095078A

United States Patent [19]

Adams

[11] Patent Number: 6,095,078

[45] Date of Patent: Aug. 1, 2000

[54] SUBMARINE PROPULSION CONTROL SYSTEM

[75] Inventor: Richard Adams, Hampshire, United Kingdom

[73] Assignee: GEC-Marconi, Ltd., Middlesex, United Kingdom

[21] Appl. No.: 09/029,239

[22] PCT Filed: Sep. 5, 1996

[86] PCT No.: PCT/GB96/02186

§ 371 Date: Jun. 29, 1998

§ 102(e) Date: Jun. 29, 1998

[87] PCT Pub. No.: WO97/10993

PCT Pub. Date: Mar. 27, 1997

[30] Foreign Application Priority Data

Sep. 21, 1995 [GB] United Kingdom ..... 9519309

[51] Int. Cl.[7] ..... B63G 8/14; B63G 8/08

[52] U.S. Cl. ..... 114/330; 114/337; 114/331

[58] Field of Search ..... 114/312, 316, 114/337, 330, 331, 20.1, 124

[56] References Cited

U.S. PATENT DOCUMENTS

| | | | |
|---|---|---|---|
| 3,148,650 | 9/1964 | Leonard . | |
| 3,362,267 | 1/1968 | Rosfelder | 114/16 |
| 3,779,194 | 12/1973 | Kahn | 114/20 |
| 4,014,280 | 3/1977 | Laxo | 114/124 |
| 5,349,915 | 9/1994 | Thomas et al. . | |

FOREIGN PATENT DOCUMENTS

| | | |
|---|---|---|
| 750 402 | 8/1933 | France . |
| 1 045 450 | 11/1953 | France . |
| 38 26 653 | 12/1989 | Germany . |
| 2 281 538 | 3/1995 | United Kingdom . |

*Primary Examiner*—S. Joseph Morano
*Assistant Examiner*—Patrick Craig Muldoon
*Attorney, Agent, or Firm*—Donald C. Casey, Esq.

[57] ABSTRACT

An underwater vehicle having a negative buoyancy and thrust units by which it can hover is described. Slow speed maneuverability while hovering is achieved by moving the position of a mass fore and aft and/or side to side such as to cause the vehicle to pitch or roll and thereby vector the otherwise vertical thrust such that the vehicle is propelled in the direction in which the mass has moved.

19 Claims, 5 Drawing Sheets

SUBMARINE PROPULSION CONTROL SYSTEM

BACKGROUND OF THE INVENTION

Description of the Prior Art

This invention relates to a submarine propulsion control system and specifically but not exclusively to a submarine propulsion control system for an expendable unmanned underwater vehicle.

In attempting to dispose of underwater mines it has been usual to place an explosive charge adjacent the mine and then detonate the explosive charge hoping that this will cause sympathetic detonation of the mines warhead, destroying the mine, or at least render the mines sensor and triggering mechanisms inoperative, rendering the mine harmless. Placement of such charges has been carried out by a human diver or by a remote controlled submersible.

Both of these methods have drawbacks. The main drawback is the high risk to the diver or submersible and it is in fact due to the unacceptably high risk to the diver that submersibles are used. However the very high cost of a submersible able to carry an explosive charge to a mine location, deploy the charge adjacent the mine, and return to the mother ship makes loss of the submersible unacceptable, in addition the weight and bulk of the submersible is such that only a very limited number can be stowed aboard a warship and as a result the vehicles mine sweeping capability could rapidly be lost due to destruction of the submersibles. A further disadvantage is that the time taken to dispose of a mine is by these conventional methods is quite long due to the need to get the diver or submersible to a safe distance before detonating the charge and the need for the diver or submersible to return to the mother ship, which must always remain at a safe distance from the mine throughout the operation, to pick up further explosive charges. Since the combined explosive effect of the mine warhead and the disposal charge may be very great the safe distance is relatively large.

It has been proposed to overcome these drawbacks by employing an expendable remotely controlled submersible containing an explosive charge and simply moving the submersible into close proximity to a mine and detonating the charge, destroying the submersible and hopefully detonating the mine warhead or disabling the mine sensor and detonation mechanisms simultaneously. The bulk and expense of such an expendable submersible can be very much less than that of a conventional reusable submersible since there is no need to include any explosive charge deployment mechanism, the range and operational life need only be sufficient for a one way trip to the target mine and all of the control and power systems can be 'one shot' devices.

In designing such an expendable submersible it has proved difficult to make the submersible easily and accurately controllable so as to ensure that it can be got into close proximity to the target mine before detonation while simultaneously keeping the submersible cheap and light so as to allow a large number to be carried aboard the mother ship and to allow large numbers to be purchased, the arrangement of motors and propellers to provide forward thrust and the necessary control surfaces to allow controlled horizontal and vertical movement of the submersible has proved particularly difficult.

UK Patent Application Publication Number GB 2281538 attempts to solve the above mentioned problems. This earlier patent application discloses two embodiments, each comprising an unmanned underwater vehicle, cylindrical in shape, propelled by two propellers mounted on arms on either side of the cylindrical body. In both embodiments the arms can be rotated such that the propellers can either be faced in a forward direction, in order to propel the vehicle forwards, or in a vertical direction such as to raise or lower the vehicle, the vehicle having a negative buoyancy.

In one embodiment disclosed in GB 2281538 the arms on which the thrust units are mounted are biased by a spring to a position whereby thrust is generated in a vertical direction. At higher levels of thrust the spring bias is overcome by the force on the arms and these pivot to a position where the thrust is directed in a rearward direction propelling the vehicle forward. In a second embodiment the direction of the thrust units is changed from vertical to horizontal by a transducer within the hull of the vehicle which rotates a shaft through 90° on which the arms are mounted.

The two embodiments disclosed in GB 2281538, described above, are adequate for carrying a warhead into close proximity to a mine to be destroyed, where detonation of the warhead in close proximity to the mine destroys the mine by a sympathetic detonation occurring within the mine. However, more recently, mines have employed new explosive materials such as plastics explosive which are not susceptible to sympathetic detonation. In order to destroy such mines it is desirable to be able to accurately position a shaped charge adjacent the mine such that the blast from the shaped charge is actually focused within the mine to be destroyed. Another advantage of using a directional shaped charge is that even if used against a conventional mine a smaller charge can be used than would be required to ensure a sympathetic detonation and therefore the size of the vehicle carrying the charge can be reduced. This results in a cheaper mine destruction vehicle and also enables more vehicles to be carried by mine clearance vessels. It may also enable the vehicle to be small enough to be deployed from a helicopter.

In order to correctly position a shaped charge relative to a mine to be exploded, it is necessary not only to pilot the vehicle into close proximity to the mine but also to be able to fully control the manoeuvrability of that vehicle when it reaches the mine. It is therefore desirable that such a vehicle be able to perform slow speed manoeuvres whilst substantially in a hover position.

SUMMARY OF THE INVENTION

According to a first aspect of the present invention there is provided a propulsion control system for a submersible vehicle comprising at least one thrust unit for exerting a substantially vertical thrust to control the depth of the vehicle, and means for laterally displacing the centre of gravity of the vehicle relative to the major axis of the vehicle such as to change the attitude of the vehicle and thrust unit and thereby control transverse displacement of the vehicle.

By employing the present invention the vertical thrust required to control the vertical displacement of the vehicle can be utilised to provide a slow speed horizontal displacement of the vehicle for low speed manoeuvrability of the vehicle. The centre of gravity can be moved sideways which will cause the vehicle to list and therefore the thrust will be vectored and cause the vehicle to traverse sideways. Alternatively, or in addition, the centre of gravity can be moved fore and aft which will cause the vehicle to pitch, thereby vectoring the thrust either fore or aft such that the vehicle moves either forwards or backwards.

One way in which the centre of gravity may be moved is by displacing a mass within the vehicle, and it may be convenient to displace the battery of the vehicle if the vehicle is battery powered as the battery normally has a very high density.

One way of conveniently moving the mass is by rotating it about a shaft extending along the major axis of the vehicle. The mass can then conveniently be moved fore and aft along the shaft to control the longitudinal centre of gravity. If space permits, an alternative arrangement could be employed where the shaft runs across the vehicle.

Where the vehicle comprises two thrust units located on either side of it, the centre of gravity can be displaced to compensate for any differential thrust which would tend to cause the vehicle to list and therefore traverse sideways.

The invention is particularly advantageously employed where the position of the at least one thrust unit can be varied relative to the vehicle such that in a first position it propels the vehicle in a forward direction and in a second position exerts a vertical thrust to control the depth of the vehicle. In such an arrangement in the first position the at least one thrust unit will propel the vehicle forward, and when reaching the target the thrust unit can be moved to the second position so as to maintain the vehicle in a hover position, whereby fine positioning of the vehicle can be achieved by moving the centre of gravity. In such a system it is preferable that the thrust unit be attached to a support arm which biases the thrust unit to the second position at low levels of thrust but where at high levels of thrust the bias is overcome by the force exerted by the thrust unit on the arm causing the thrust unit to adopt the first position. This enables the position of the thrust unit to be controlled by the thrust applied without the need for an additional actuator.

According to a second aspect of the invention there is provided a remotely operated underwater vehicle incorporating the above propulsion control system preferably carrying an integral shaped charge warhead. Using a vehicle embodying such a propulsion control system enables the warhead to be correctly positioned relative to a mine to be destroyed.

One embodiment of the present invention will now be described, by way of example only, with reference to the accompanying drawings throughout which like numerals have been used to indicate like parts, and of which:

DETAILED DESCRIPTION OF THE INVENTION

Figure 1A:
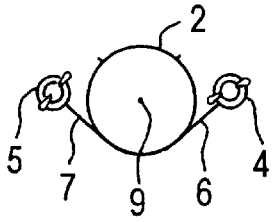
FIGS. 1A and 1B are respectively a front elevation and side elevation of a submersible vehicle employing a propulsion system in accordance with the present invention when the propulsion system is deployed for forward propulsion of the submersible vehicle.
Figure 1B:
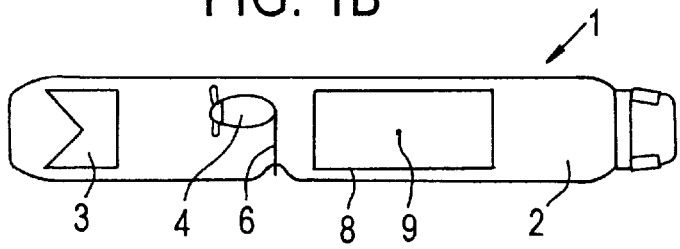

FIGS. 1A and 1B are respective front and side views of an unmanned submersible mine counter-measures vehicle 1 comprising a hull 2 incorporating a shaped charge warhead 3, to be positioned facing a mine, and two thrust units 4 and 5. Each thrust unit 4, 5 comprises an electric motor and small propeller but could be any other suitable form of thrust unit. Each thrust unit 4, 5 is connected by a respective motor arm 6, 7 to the hull 2 of the vehicle.

The vehicle 1 also comprises means for displacing the centre of gravity of the vehicle fore and aft and/or side to side and this is represented in FIG. 1A by box 8. The apparatus for moving the centre of gravity is described below with reference to FIGS. 9A and 9B.

For clarity, the shaped charge warhead 3 and means for moving the centre of gravity 8 have been omitted from FIGS. 2 to 8. However, a displaceable mass is represented in FIGS. 1 through to 8 by dot 9, and where this is moved from its normal rest position this is indicated by arrow 10, which arrow 10 also indicates the direction in which the centre of gravity of the vehicle has moved.

In FIGS. 1A and 1B the thrust units 4, 5 are illustrated in a forward position which they adopt when a large thrust force is exerted by the units which will act to propel the vehicle forward. This would be the position adopted by the thrust units when the vehicle was cruising to a target. The mechanism by which the position of the thrust units is controlled is also described below with reference to FIGS. 10 and 11.

Figure 2A:
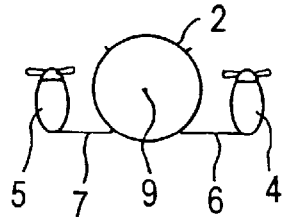
FIGS. 2A and 2B are respectively a front elevation and side elevation of the submersible vehicle of FIGS. 1A and 1B where the propulsion units are in a position such that the vehicle will hover.
Figure 2B:
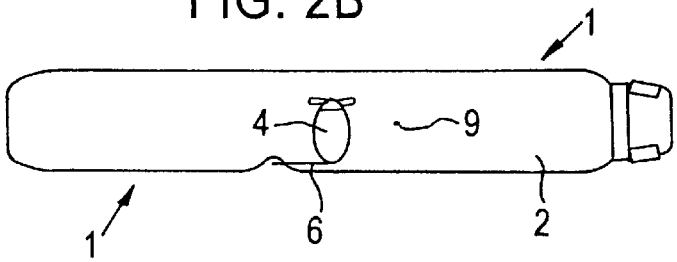

When the vehicle reaches its target the thrust is reduced and the thrust units 4, 5 are urged by bias means to the position illustrated in FIGS. 2A and 2B. With the mass illustrated by dot 9 in its normal position, the centre of gravity in combination with the thrust units 4, 5 acts to maintain the vehicle in a stationary hover position, the thrust units 4, 5 acting against the negative buoyancy of the vehicle.

Figure 3:
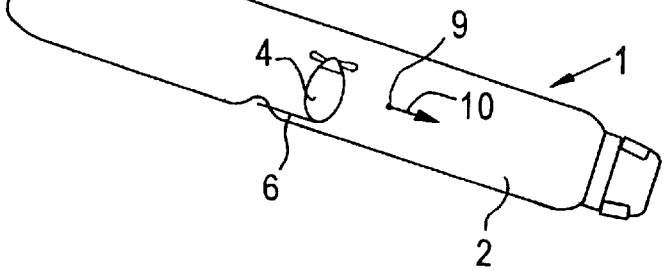
FIG. 3 is a side elevation of the submersible vehicle schematically illustrating the effect of shifting the center of gravity of the vehicle aft.
Figure 4:
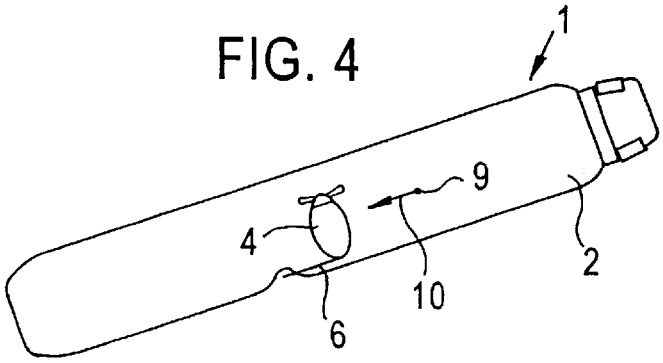
FIG. 4 is a side elevation of the submersible vehicle schematically illustrating the effect of shifting the center of gravity of the vehicle forward.

By moving the mass 9 aft, as indicated by arrow 10 in FIG. 3, the vehicle will pitch as illustrated in FIG. 3 whereby the thrust from thrust units 4, 5 will comprise a component directed in a forward direction thereby slowly propelling the vehicle 1 backwards. This thereby enables the vehicle to be moved slowly backwards while maintaining a hover position simply by the movement of a mass within the hull. In a similar manner to that described with reference to FIG. 3, when the mass 9 is moved forward as illustrated in FIG. 4, the vehicle 1 will pitch forward causing a component of the thrust from thrust units 4, 5 to be directed in a rearward direction, thereby propelling the vehicle forward.

Figure 5:
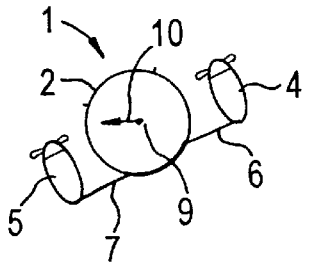
FIG. 5 is a front elevation of the submersible vehicle schematically illustrating the effect of laterally displacing the center of gravity to the starboard side of the vehicle.

Referring to FIG. 5 it is seen that when the mass 9 is moved to the starboard side of the vehicle the vehicle will list to starboard causing a component of the thrust from thrust units 4, 5 to be directed to port, thereby causing the vehicle 1 to traverse to starboard.

Figure 6:
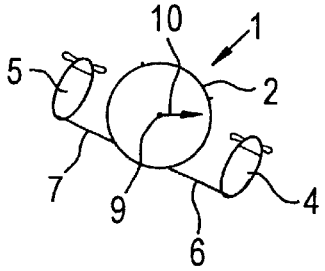
FIG. 6 is a front elevation of the submersible vehicle schematically illustrating the effect of shifting the center of gravity to the port side of the vehicle.

FIG. 6 illustrates the position that will be adopted when the mass is shifted to port which will cause the vehicle to traverse to port.

Figure 7A:
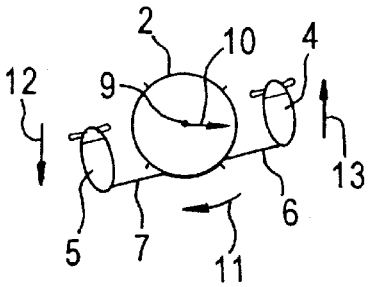
FIGS. 7A and 7B are respectively a front elevation and side elevation and illustrate the effect of a differential thrust applied to the thrust units.
Figure 7B:
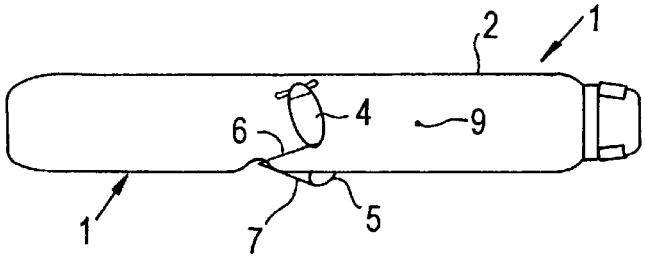

In FIGS. 7A and 7B the thrust units are illustrated in a position which will be adopted when a differential low level thrust is applied, as described below with reference to FIGS. 10 and 11. In this position thrust unit 4 will provide a forward component while thrust unit 5 provides a rearward component rotating the vehicle in azimuth as indicated by arrow 8. For the thrust units to adopt this position the thrust on unit 4 must be greater than that on thrust unit 5 which will tend to cause the vehicle to list as indicated by arrows 12 and 13. To maintain an upright position the mass 9 within the vehicle is moved such as to move the centre of gravity in a direction indicated by arrow 10. This enables the vehicle to be rotated in azimuth without traversing.

Figure 8A:
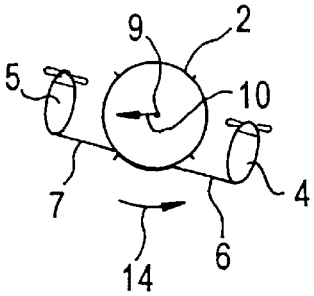
FIGS. 8A and 8B are respectively a front elevation and side elevation and side elevation of a submersible vehicle schematically illustrating the effect of a differential thrust between the thrust units in the opposite sense to that of FIGS. 7A and 7B.
Figure 8B:
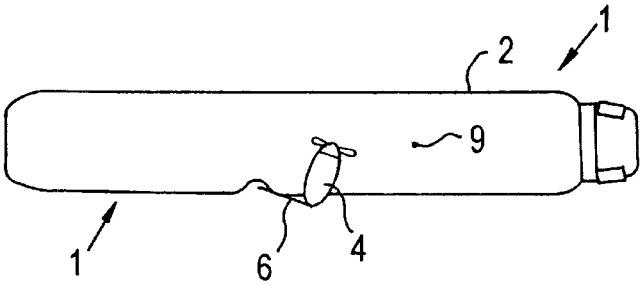

Referring to FIGS. 8A and 8B there is illustrated the position the thrust units 4 and 5 will adopt when the thrust from unit 5 is greater than that from unit 4, and this will cause the vehicle to rotate as indicated by arrow 14. Again, a differential thrust will tend to cause the vehicle to list but this can be compensated for by shifting the centre of gravity in the direction of arrow 10. Any list generated by differential thrust from units 4 and 5 can be compensated for automatically by the vehicle without any need for further control signals.

Figure 9A:
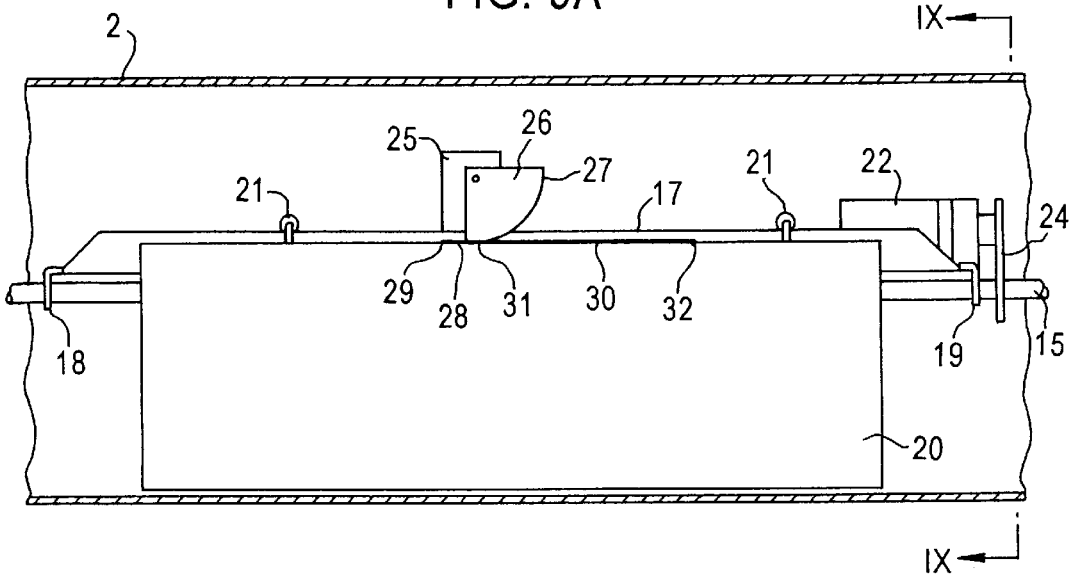
FIG. 9A is a side view of the means for altering the centre of gravity employed in the vehicle illustrated in FIGS. 1 to 8.
Figure 9B:
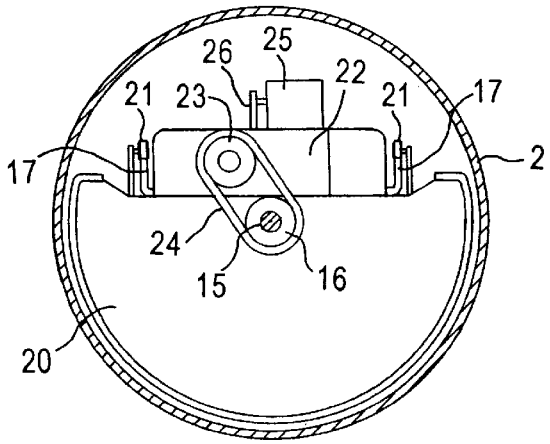
FIG. 9B is a cross section along the line IX—IX of FIG. 9A.

Referring to FIG. 9A there is shown the arrangement inside the hull 2 of the vehicle 1 by which the centre of gravity of the vehicle can be moved both transversely and axially. FIG. 9B is a cross section along the line IV—IV of FIG. 4A.

Within the hull 2 there is a central rod 15 to which sprocket 16 is attached. The rod 15 which forms the main chassis of the vehicle also supports gantry 17 via brackets 18, 19. The gantry 17 supports a relatively large mass 20, typically the battery power pack for the vehicle 1, by means of runners 21. The gantry also supports a motor 22 for driving sprocket 23 which is connected to sprocket 15 via chain 24. Operation of the motor 22 causes the gantry 17 and associated mass 20 to be rotated about rod 15 which thereby transversely shifts the centre of mass within the hull 2.

The gantry 17 also supports actuator 25 which rotates quadrant 26. Quadrant 26 is attached at point 27 to cord 28 which runs along the edge of the quadrant 26 and is attached to the mass at 29. Similarly cord 30 is attached to the quadrant at point 31 and the mass at point 32. Rotation of the quadrant 26 causes the mass 20 to move forward and aft within the vehicle shifting the centre of gravity accordingly.

Figure 10:
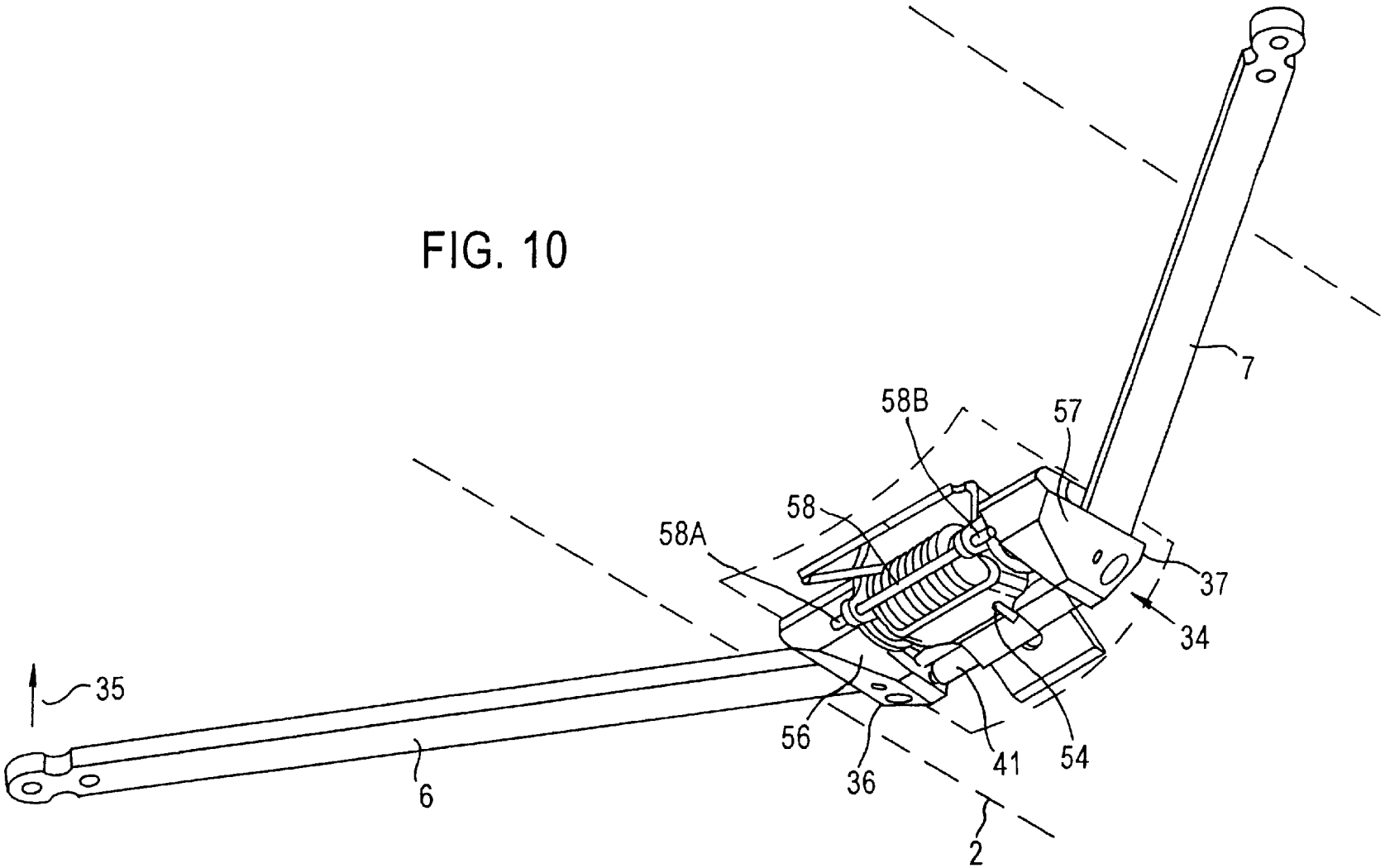
FIG. 10 shows the linkage control mechanism of the propulsion control system employed on the submersible vehicle illustrated in FIGS. 1 to 8.

Referring to FIG. 10 there is shown the linkage mechanism indicated generally as 34 by which motor arms 6 and 7 are connected to the hull 2, indicated by the broken lines, of the vehicle 1. The thrust units, not shown for clarity, are mounted on the ends of the arms 6 and 7 and exert a force on the arms in the direction indicated by arrows 35. The working of the linkage mechanism 34 will be better understood from a study of FIG. 11 which illustrates the various components of the mechanism.

Figure 11:
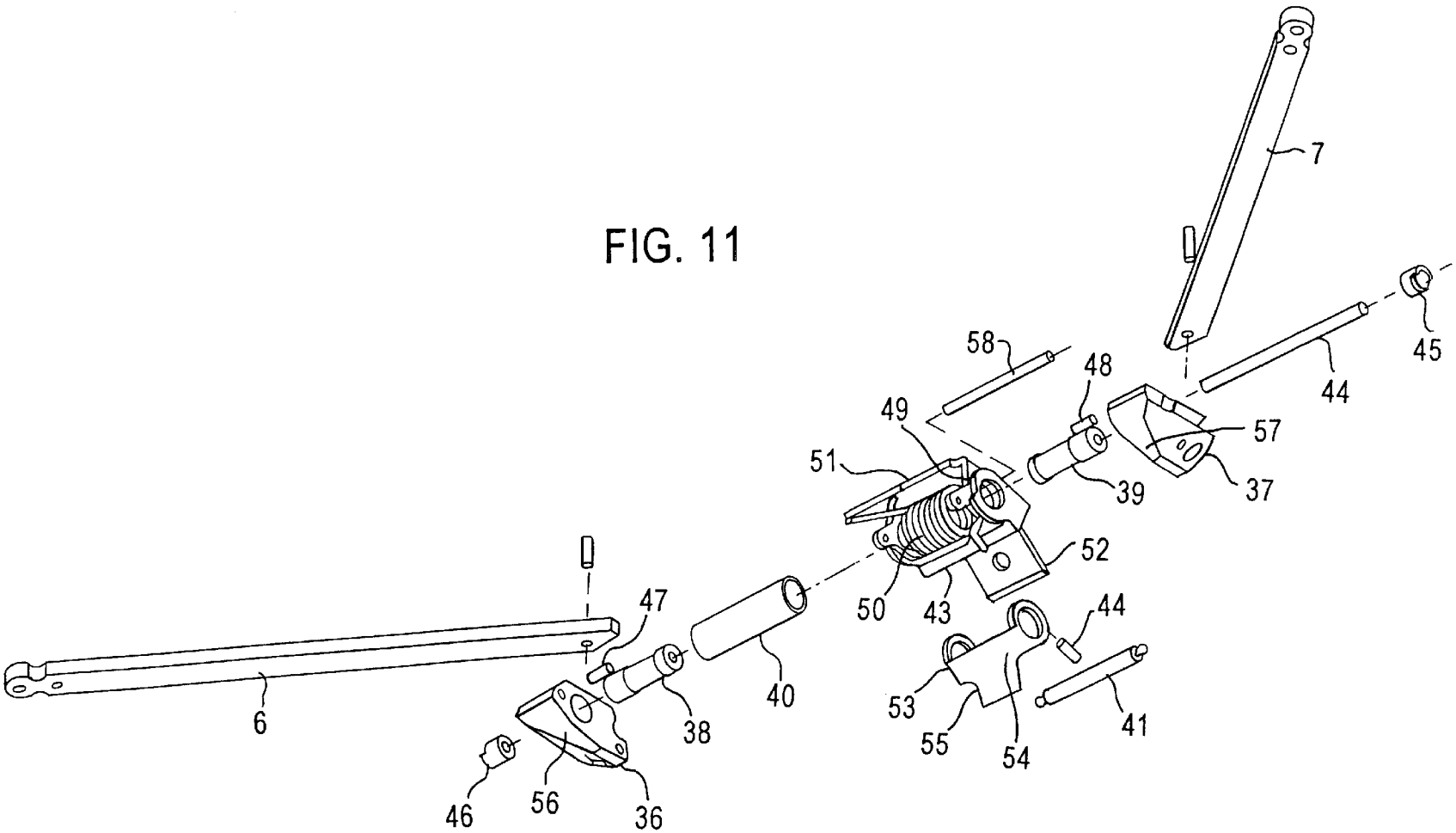
FIG. 11 shows the components of the linkage mechanism illustrated in FIG. 10.

Referring to FIG. 11 the two motor arms 6 and 7 are mounted via respective brackets 36 and 37 on respective spindles 38 and 39 which fit into traverse tube 40. The arms 6 and 7 are linked by differential link 41 which has spherical ends which locate in holes in brackets 36 and 37. The differential link 41 pivots about pivot pin 42 at its centre which protrudes from pivot plate 43. The pivot plate 43 is itself free to rotate about traverse tube 40. Because the differential link 41 is pivoted on pin 42, which is in turn held in position by pivot plate 43, the arms 6 and 7 are constrained by brackets 36 and 37 such that they can only move in opposite directions to one another, unless the differential link is displaced, when the whole assembly is held together by rod 44 and nuts 45 and 46. The rod 44 passes through brackets 36 and 37, spindles 38 and 39 and tube 40. The arms 6 and 7 are further constrained by pins 47 and 48 which extend from respective mounting brackets 36 and 37 and engage in slots 49 in the pivot plate 43, only one of which can be seen. These slots restrict the total differential movement to approximately ±15°.

Torsion spring 50 acts between flange 51 of base plate 52, which is mounted to the vehicle, and spring plate 53, the spring engaging in hole 54 of the spring plate, as can be more clearly seen from FIG. 10. The spring urges the tail piece 55 of the spring plate 53 against the differential link 41 which urges both arms 6 and 7 into the position illustrated in FIG. 10, and also FIG. 1B, which position is referred to as the hover position. When a differential, relatively low level thrust is applied the difference in the turning forces applied to each bracket 36 and 37 will cause the differential link pin 41 to pivot about the pivot pin 42 causing the differential link pin 41 to be urged against one side of the tail piece 55 of the spring plate 53. Thus the spring plate 53 will urge the differential link back into a centring position when the thrust is equalised.

As the thrust is increased the whole of the linkage mechanism will pivot about rod 44, which is held in position by passing through the base plate 52, against the force of the spring 50 acting on differential link pin 41. As the thrust increases further the respective thrust limit faces 56, 57 on brackets 36 and 37 will contact with the ends 58A and 58B of thrust limit pin 58. Therefore above a certain thrust any differential in thrust will not alter the position of the thrust units, this being determined by the thrust limit faces 56, 57, and thus the thrust units will be held in a position as shown in FIG. 1A. In this position the units 4, 5 are slightly inclined to compensate for the negative buoyancy of the vehicle 1. In this position differential thrust can be applied to steer the vehicle to port or starboard whilst proceeding forward.

The above describes an embodiment where the invention is used to enable the position of a mine counter-measures vehicle to direct a shaped charge at a mine. It will, however, be appreciated that the invention could be employed with other types of submersible vehicle, including manned vehicles.

What is claimed is:

1. A propulsion control system for a submersible vehicle comprising at least one thrust unit for exerting a substantially vertical thrust to control the depth of the vehicle, and means for laterally displacing the centre of gravity of the vehicle relative to the major axis of the vehicle such as to change the attitude of the vehicle and thrust unit and thereby control transverse displacement of the vehicle.

2. A system as claimed in claim 1 wherein the centre of gravity can be moved fore and aft to cause the vehicle to proceed in a forward or backward direction respectively.

3. A system as claimed in claim 1 wherein the centre of gravity is moved by displacing a mass within the vehicle.

4. A system as claimed in claim 3 wherein the mass is a battery of the vehicle.

5. A system as claimed in claim 3 wherein the mass is rotated about a shaft extending along the major axis of the vehicle.

6. A system as claimed in claim 5 wherein the mass can be moved fore and aft along the shaft to control the centre of gravity.

7. A system as claimed in claim 1 comprising two thrust units one on either side of the vehicle, wherein the center of gavity can be displaced to compensate for any differential thrust.

8. A system as claimed in claim 1 where the position of the at least one thrust unit can be varied relative to the vehicle such that in a first position it propels the vehicle in a forward direction and in a second position exerts a vertical thrust to control the depth of the vehicle.

9. A system as claimed in claim 1 wherein the thrust unit is attached to a support arm which biases the thrust unit to the second position at low levels of thrust but at high levels the thrust is overcome by the force exerted by the thrust unit on the arm causing the thrust unit to adopt the first position.

10. A remotely operated underwater vehicle comprising a propulsion system as claimed in claim 1.

11. A vehicle as claimed in claim 10 further comprising a warhead for the destruction of mines.

12. A vehicle as claimed in claim 11 wherein the warhead is an integral shaped charge.

13. A propulsion control system for a submersible vehicle comprising at least one thrust unit for exerting a substantially vertical thrust to control the depth of the vehicle, and means for laterally displacing the center of gravity of the vehicle relative to the major axis of the vehicle such as to change the attitude of the vehicle and thrust unit and thereby control transverse displacement of the vehicle including a mass within the vehicle and a shaft extending along the major axis of the vehicle and mean for displacing said mass by rotating said mass about said shaft.

14. The system of claim 13 wherein the center of gravity can be moved fore and aft to cause the vehicle to proceed in a forward or backward direction, respectively.

15. The system of claim 13 wherein said mass is a battery of the vehicle.

16. The system of claim 13 wherein said mass can be moved fore and aft along the shaft to control the center of gravity.

17. The system of claim 13 comprising two thrust units, one on either side of the vehicle, wherein the center of gravity can be displaced to compensate for any differential thrust.

18. The system of claim 13 wherein the position of at least one thrust unit can be varied relative to the vehicle such that in a first position it propels the vehicle in a forward direction and in a second position exerts a vertical thrust to control the depth of the vehicle.

19. The system of claim 13 wherein the thrust unit is attached to a support arm which biases the thrust unit to the second position at low levels of thrust but at high levels the bias is overcome by the force exerted by the thrust unit on the arm causing the thrust unit to adopt the first position.

* * * * *